US006894010B2

(12) United States Patent
Ikeda

(10) Patent No.: US 6,894,010 B2
(45) Date of Patent: May 17, 2005

(54) LUBRICATING OIL COMPOSITION FOR REFRIGERATING MACHINE

(75) Inventor: Harutomo Ikeda, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 162 days.

(21) Appl. No.: 10/258,607

(22) PCT Filed: May 17, 2001

(86) PCT No.: PCT/JP01/04123

§ 371 (c)(1),
(2), (4) Date: Nov. 5, 2002

(87) PCT Pub. No.: WO01/90282

PCT Pub. Date: Nov. 29, 2001

(65) Prior Publication Data

US 2003/0158056 A1 Aug. 21, 2003

(30) Foreign Application Priority Data

May 22, 2000 (JP) ..... 2000-149285

(51) Int. Cl.[7] ..... C10M 171/02; C10M 107/34
(52) U.S. Cl. ..... 508/579; 252/68
(58) Field of Search ..... 508/579; 252/68

(56) References Cited

U.S. PATENT DOCUMENTS 4,755,316 A * 7/1988 Magid et al. ..... 252/68
4,900,463 A 2/1990 Thomas et al. ..... 252/68
4,931,199 A 6/1990 Bierschenk et al. ..... 252/68
4,948,525 A * 8/1990 Sasaki et al. ..... 508/304
6,054,422 A * 4/2000 Ward et al. ..... 508/579
6,074,573 A * 6/2000 Kaneko ..... 252/68
6,239,086 B1 * 5/2001 Hirano et al. ..... 508/579
6,306,803 B1 * 10/2001 Tazaki ..... 508/539
6,478,983 B1 * 11/2002 Matsuura et al. ..... 252/68
6,613,725 B1 * 9/2003 Tazaki ..... 508/579
6,734,151 B1 * 5/2004 Kubota et al. ..... 508/579

FOREIGN PATENT DOCUMENTS

| | | |
|---|---|---|
| JP | 55-58298 | 4/1980 |
| JP | 62-59695 | 3/1987 |
| JP | 63-309592 | 12/1988 |
| JP | 1-115998 | 5/1989 |
| JP | 1-115999 | 5/1989 |
| JP | 1-198694 | 8/1989 |
| JP | 2-140296 | 5/1990 |
| JP | 2-140297 | 5/1990 |
| JP | 2-140298 | 5/1990 |
| JP | 9-235577 | 9/1997 |
| JP | 2000-169867 | 6/2000 |
| JP | 2001-3069 | 1/2001 |
| JP | 2001-107066 | 4/2001 |
| WO | 00/43464 | 7/2000 |

* cited by examiner

*Primary Examiner*—Ellen M McAvoy
(74) *Attorney, Agent, or Firm*—Oblon, Spivak, McClelland, Maier & Neustadt, P.C.

(57) ABSTRACT

A lubricating oil composition for refrigerators having a viscosity index of 250 or greater, and which contains a base oil component 1 having a kinematic viscosity of 3 $mm^2/s$ or smaller at 100° C. and a viscosity index smaller than 250 and a base oil component 2 having a kinematic viscosity of 25 $mm^2/s$ or greater at 100° C. and a viscosity index smaller than 250.

16 Claims, No Drawings

LUBRICATING OIL COMPOSITION FOR REFRIGERATING MACHINE

TECHNICAL FIELD

The present invention relates to a lubricating oil composition for refrigerators and, more particularly, to a lubricating oil composition which can be used in combination with a fluorocarbon-based refrigerant or a natural substance-based refrigerant such as carbon dioxide, ammonia and a hydrocarbon and can contribute to saving energy.

BACKGROUND ART

In recent years, in the field of refrigerators, refrigerants which have heretofore been used and have great ozonosphere destruction potential due to the contained chlorine such as chlorofluorocarbons and hydrochlorofluorocarbons are being replaced with hydrofluorocarbon-based refrigerants having the ozonosphere destruction potential of zero from the standpoint of global ozonosphere protection. At the same time, so-called natural substance-based refrigerants such as carbon dioxide, ammonia and hydrocarbons having small global warming potential are attracting attention from the standpoint of prevention of the global warming.

When the hydrofluorocarbon-based refrigerant or the natural substance-based refrigerant is used for a refrigerator, the application of mineral oil-based lubricating oils which have heretofore been used becomes difficult from the standpoint of miscibility. As the result, lubricating oils using an oil having oxygen such as a polyalkylene glycol-based oil, a polyvinyl ether-based oil, a polyol ester-based oil and a polycarbonate-based oil as the base oil are used in combination with the above refrigerants. In particular, the polyalkylene glycol-based lubricating oil for refrigerators are used as the lubricating oil for refrigerators of automobile air conditioners due to the great viscosity index.

DISCLOSURE OF THE INVENTION

However, the polyalkylene glycol-based lubricating oils which have been used as the lubricating oil for refrigerators of automobile air conditioners have a drawback in that the viscosity index of the lubricating oil is about 170 to about 230 and the loss in torque is great at the start of the refrigerator of the automobile air conditioner due to the great kinematic viscosity at low temperatures.

The present invention has been made to overcome the above drawback and has an object of providing a lubricating oil composition for refrigerators which enables the use of a fluorocarbon-based refrigerant or a natural substance-based refrigerant as the refrigerant for refrigerators and has a small kinematic viscosity at low temperatures and a suitable kinematic viscosity at high temperatures, i.e., has a great viscosity index.

As the result of intensive studies by the present inventors to achieve the above object, it was found that a lubricating oil composition for refrigerators which had a suitable kinematic viscosity at high temperatures and a small kinematic viscosity at low temperatures, i.e., had a great viscosity index, could be obtained by using a base oil component having a small viscosity as the essential component and adding a base oil component having a great viscosity to the above base oil component having a small viscosity. The present invention has been completed based on the above knowledge.

The present invention provides:

(1) A lubricating oil composition for refrigerators which comprises base oil component 1 having a kinematic viscosity of 3 $mm^2/s$ or smaller at 100° C. and a viscosity index smaller than 250 and base oil component 2 having a kinematic viscosity of 25 $mm^2/s$ or greater at 100° C. and a viscosity index smaller than 250 and has a viscosity index of 250 or greater;

(2) A lubricating oil composition described in (1), wherein a difference between kinematic viscosities of base oil component 1 and base oil component 2 is 25 $mm^2/s$ or greater at 100° C.;

(3) A lubricating oil composition described in any of (1) and (2), wherein base oil component 1 is a component represented by general formula (I):

$$R^1—O—(-A-O—)_m—R^2 \quad (I)$$

wherein $R^1$ and $R^2$ each represent hydrogen atom or a hydrocarbon group having 1 to 8 carbon atoms, A represents an alkylene group having 2 to 8 carbon atoms, m represents an integer of 1 or greater and, when m represents an integer of 2 or greater, a plurality of groups represented by A may be a same with or different from each other;

(4) A lubricating oil composition described in any of (1) to (3), wherein base oil component 2 is at least one component selected from a component represented by general formula (II):

$$R^3—O—(-A'-O—)_n—R^4 \quad (II)$$

wherein $R^3$ and $R^4$ each represent hydrogen atom or a hydrocarbon group having 1 to 8 carbon atoms, A' represents an alkylene group having 2 to 8 carbon atoms, n represents an integer of 1 or greater and, when n represents an integer of 2 or greater, a plurality of groups represented by A' may be a same with or different from each other; and a component represented by general formula (III):

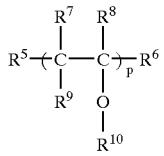

(III)

wherein $R^5$ to $R^9$ each represent hydrogen atom or a hydrocarbon group having 1 to 8 carbon atoms, $R^{10}$ represents a hydrocarbon group having 1 to 8 carbon atoms, p represents an integer of 1 or greater and, when p represents an integer of 2 or greater, a plurality of groups represented by each of $R^5$ to $R^{10}$ may be a same with or different from each other; and (5) A lubricating oil composition described in any of (1) to (4), wherein a ratio of an amount by weight of base oil component 1 to an amount by weight of base oil component 2 is in a range of 10:90 to 90:10.

THE MOST PREFERRED EMBODIMENT TO CARRY OUT THE INVENTION

The present invention will be described in more detail.

The present invention relates to a lubricating oil composition for refrigerators which comprises base oil component 1 having a kinematic viscosity of 3 $mm^2/s$ or smaller at 100° C. and a viscosity index smaller than 250 and base oil component 2 having a kinematic viscosity of 25 $mm^2/s$ or greater at 100° C. and a viscosity index smaller than 250 and has a viscosity index of 250 or greater.

As base oil component 1 having a kinematic viscosity of 3 $mm^2/s$ or smaller at 100° C. and a viscosity index smaller than 250, for example, a polyalkylene glycol, a polyvinyl ether, a polyol ester or a polycarbonate having a kinematic viscosity in the above range can be used singly or in combination of two or more. In the present invention, a polyalkylene glycol is preferable among the above compounds due to the great viscosity index.

When base oil component 1 has a kinematic viscosity exceeding 3 $mm^2/s$, the obtained lubricating oil composition has a great kinematic viscosity at low temperatures and the viscosity index decreases. Therefore, such a base oil component is not preferable. In the present invention, it is more preferable that base oil component 1 has a kinematic viscosity of 2.5 $mm^2/s$ or smaller.

It is preferable that the lubricating oil composition of the present invention comprises base oil component 1 in an amount of 10 to 90% by weight, more preferably 20 to 85% by weight and most preferably 30 to 80% by weight. When the amount is less than the above range, occasionally, the kinematic viscosity of the obtained lubricating oil composition at low temperatures increases and the viscosity index decreases. When the amount exceeds the above range, occasionally, it becomes difficult that the suitable kinematic viscosity is maintained.

As base oil component 2 which is used in combination with base oil component 1 and has a kinematic viscosity of 25 $mm^2/s$ or greater at 100° C. and a viscosity index smaller than 250, for example, a polyalkylene glycol, a polyvinyl ether, a polyol ester or a polycarbonate having a kinematic viscosity in the above range can be used singly or in combination of two or more. In the present invention, a polyalkylene glycol is preferable among the above compounds due to the great viscosity index.

When base oil component 2 has a kinematic viscosity of 25 $mm^2/s$ or greater, the kinematic viscosity of the obtained lubricating oil composition at low temperatures can be suppressed at a small value and the viscosity index can be kept great. In the present invention, from the above standpoint, it is more preferable that base oil component 2 has a kinematic viscosity of 30 $mm^2/s$ or greater and more preferably 40 $mm^2/s$ or greater at 100° C.

In the present invention, it is preferable that the difference between kinematic viscosities of base oil component 1 and base oil component 2 is 25 $mm^2/s$ or greater at 100° C. When this difference is smaller than 25 $mm^2/s$, occasionally, the object of the present invention is not achieved since the kinematic viscosity of the obtained lubricating oil composition increases at low temperatures and the viscosity index decreases. From the above standpoint, it is more preferable that the difference between kinematic viscosities of base oil component 1 and base oil component 2 is 30 $mm^2/s$ or greater and most preferably 40 $mm^2/s$ or greater at 100° C.

It is preferable that the lubricating oil composition of the present invention comprises base oil component 2 in an amount of 10 to 90% by weight, more preferably 15 to 80% by weight and most preferably 20 to 70% by weight. When the amount is less than the above range, occasionally, it becomes difficult that the suitable kinematic viscosity is maintained at high temperatures. When the amount exceeds the above range, occasionally, the kinematic viscosity of the obtained lubricating oil composition at low temperatures increases and the viscosity index decreases.

In the lubricating oil composition for refrigerators of the present invention, it is preferable that the ratio of the amount by weight of base oil component 1 to the amount by weight of base oil component 2 is in the range of 10:90 to 90:10, more preferably 20:80 to 85:15 and most preferably 30:70 to 80:20 from the standpoint of achieving the object of the present invention.

In the present invention, when a polyalkylene glycol is used as the base oil component, it is preferable that a low viscosity component represented by the above general formula (I) and having a kinematic viscosity of 3 $mm^2/s$ or smaller at 100° C. and a viscosity index smaller than 250 is used as base oil component 1 and that a high viscosity component represented by the above general formula (II) and/or a high viscosity component represented by the above general formula (III), both having a kinematic viscosity of 25 $mm^2/s$ or greater and a viscosity index smaller than 250, is used as base oil component 2 in combination with base oil component 1.

In general formula (I), $R^1$ and $R^2$ each represent hydrogen atom or a hydrocarbon group having 1 to 8 carbon atoms. Examples of the hydrocarbon group include alkyl groups, alkenyl groups, alkynyl groups, cycloalkyl groups, aryl groups and aralkyl groups. In the present invention, alkyl groups having 1 to 4 carbon atoms such as methyl group, ethyl group, n-propyl group, isopropyl group, allyl group, n-butyl group and isobutyl group are preferable.

A represents an alkylene group having 2 to 8 carbon atoms. Preferable examples of the alkylene group include methylene group, ethylene group, propylene group and butylene group.

m represents an integer of 1 or greater, preferably 2 or greater and more preferably 3 to 6. When m represents an integer of 2 or greater, a plurality of groups represented by A may be the same with or different from each other. Examples of the component represented by general formula (I) in which a plurality of groups represented by A are different from each other include components comprising ethylene group and propylene group in amounts such that the ratio of the amount of ethylene group to the amount of propylene group is in the range of 0:100 to 50:50.

In general formula (II), $R^3$ and $R^4$ each represent hydrogen atom or a hydrocarbon group having 1 to 8 carbon atoms. Examples of the hydrocarbon group include alkyl groups, alkenyl groups, alkynyl groups, cycloalkyl groups, aryl groups and aralkyl groups. In the present invention, alkyl groups having 1 to 4 carbon atoms such as methyl group, ethyl group, n-propyl group, isopropyl group, allyl group, n-butyl group and isobutyl group are preferable.

A' represents an alkylene group having 2 to 8 carbon atoms. Preferable examples of the alkylene group include methylene group, ethylene group, propylene group and butylene group.

n represents an integer of 1 or greater, preferably 30 or greater and more preferably 35 to 60. When n represents an integer of 2 or greater, a plurality of groups represented by A' may be the same with or different from each other. Examples of the component represented by general formula (II) in which a plurality of groups represented by A' are different from each other include components comprising ethylene group and propylene group in amounts such that the ratio of the amount of ethylene group to the amount of propylene group is in the range of 0:100 to 50:50.

In general formula (III), $R^5$ to $R^9$ each represent hydrogen atom or a hydrocarbon group having 1 to 8 carbon atoms. Examples of the hydrocarbon group include alkyl groups, alkenyl groups, alkynyl groups, cycloalkyl groups, aryl groups and aralkyl groups. In the present invention, hydrogen atom and alkyl groups having 1 to 4 carbon atoms such as methyl group, ethyl group, n-propyl group, isopropyl group, n-butyl group and isobutyl group are preferable.

$R^{10}$ represents a hydrocarbon group having 1 to 8 carbon atoms. Examples of the hydrocarbon group include alkyl groups, alkenyl groups, alkynyl groups, cycloalkyl groups, aryl groups and aralkyl groups. In the present invention, alkyl groups having 1 to 4 carbon atoms such as methyl group, ethyl group, n-propyl group, isopropyl group, n-butyl group and isobutyl group are preferable.

p represents an integer of 1 or greater, preferably 25 or greater and more preferably 30 to 50. When p represents an integer of 2 or greater, a plurality of groups represented by each of $R^5$ to $R^{10}$ may be the same with or different from each other.

In the present invention, the above compound represented by general formula (II) and the above compound represented by general formula (III) may be used in combination with the above compound represented by general formula (I) singly or as a combination of these compounds.

The lubricating oil composition for refrigerators of the present invention has a viscosity index of 250 or greater. When the viscosity index is smaller than 250, there is a drawback in that the loss in torque at the start of refrigerators of automobile air conditioners increases and a lubricating oil composition having such a viscosity index is not preferable. From this standpoint, it is preferable that the viscosity index is 260 or greater.

It is preferable that the lubricating oil composition for refrigerator of the present invention has a kinematic viscosity of 5 to 35 $mm^2/s$, more preferably 5.5 to 25 $mm^2/s$ and most preferably 6 to 15 $mm^2/s$ at 100° C. from the standpoint of maintaining the suitable kinematic viscosity at high temperatures and also from the object of the present invention.

As described above, the lubricating oil composition for refrigerator of the present invention comprises base oil component 1 and base oil component 2 which is used in combination with base oil component 1. Where desired, the lubricating oil composition for refrigerators of the present invention may further comprise various additives conventionally used for lubricating oils such as load carrying additives, chlorine scavengers, antioxidants, metal inactivators, defoaming agents, detergent dispersants, viscosity index improvers, oiliness agents, antiwear additives, extreme pressure agents, rust preventives, corrosion inhibitors and pour point improvers as long as the object of the present invention is not adversely affected.

The lubricating oil composition for refrigerators of the present invention can be advantageously used in combination with hydrofluorocarbon-based refrigerants having the ozonosphere destruction potential of zero or so-called natural substance-based refrigerants such as carbon dioxide, ammonia and hydrocarbons having small global warming potential. When the composition is used as the lubricating oil for refrigerators of automobile air conditioners such as automobile air conditioners of the clutchless type, the lubricating oil composition can contribute to the decrease in the energy since the loss in torque at low temperatures can be decreased.

As described in detail in the above, in accordance with the present invention, the lubricating oil composition for refrigerators which has a suitable kinematic viscosity at high temperatures and a small kinematic viscosity at low temperatures, i.e., has a great viscosity index, can be provided. The lubricating oil composition for refrigerators can be advantageously used for hydrofluorocarbon-based refrigerants having the ozonosphere destruction potential of zero or so-called natural substance-based refrigerants such as carbon dioxide, ammonia and hydrocarbons having small global warming potential. When the composition is used as the lubricating oil for refrigerators of automobile air conditioners such as automobile air conditioners of the clutchless type, the lubricating oil composition can contribute to the decrease in the energy since the loss in torque at low temperatures can be decreased.

The present invention will be described more specifically with reference to examples in the following.

EXAMPLES 1 TO 16 AND COMPARATIVE EXAMPLES 1 TO 6

Lubricating oil compositions containing components shown in Table 1 were prepared and the kinematic viscosity and the viscosity index of the prepared lubricating oil compositions were measured. The results are shown in Table 1.

The kinematic viscosity was measured in accordance with the method of Japanese Industrial Standard K2283 and the viscosity index was measured in accordance with the method of Japanese Industrial Standard K2284.

TABLE 1

| | Base oil component 1 | Base oil component 2 | Ratio of amounts | Kinematic viscosity of composition ($mm^2/s$) −30° C. | 40° C. | 100° C. | Viscosity index |
|---|---|---|---|---|---|---|---|
| Example 1 | P-1 | Q-1 | 55:45 | 2800 | 40.47 | 10.49 | 262 |
| Example 2 | P-1 | Q-1 | 58:42 | 2400 | 36.02 | 9.531 | 265 |
| Example 3 | P-1 | Q-1 | 70:30 | 1200 | 22.47 | 6.405 | 265 |
| Example 4 | P-1 | Q-2 | 50:50 | 3200 | 43.87 | 11.30 | 263 |
| Example 5 | P-1 | Q-2 | 53:47 | 2600 | 39.32 | 10.31 | 265 |
| Example 6 | P-1 | Q-2 | 56:44 | 2200 | 35.13 | 9.39 | 268 |
| Example 7 | P-1 | Q-2 | 70:30 | 1100 | 20.53 | 5.96 | 268 |
| Example 8 | P-2 | Q-1 | 50:50 | 3400 | 52.15 | 13.34 | 267 |
| Example 9 | P-2 | Q-1 | 60:40 | 2300 | 36.42 | 9.901 | 275 |
| Example 10 | P-2 | Q-1 | 70:30 | 1300 | 25.07 | 7.230 | 280 |
| Example 11 | P-2 | Q-2 | 50:50 | 3400 | 48.47 | 12.52 | 267 |
| Example 12 | P-2 | Q-2 | 60:40 | 2000 | 34.32 | 9.358 | 274 |
| Example 13 | P-2 | Q-2 | 70:30 | 1200 | 23.96 | 6.897 | 276 |
| Example 14 | P-2 | Q-3 | 50:50 | 2600 | 38.79 | 10.20 | 265 |
| Example 15 | P-2 | Q-3 | 60:40 | 1600 | 28.40 | 7.855 | 270 |

TABLE 1-continued

| | Base oil component 1 | Base oil component 2 | Ratio of amounts | Kinematic viscosity of composition ($mm^2/s$) −30° C. | 40° C. | 100° C. | Viscosity index |
|---|---|---|---|---|---|---|---|
| Example 16 | P-2 | Q-4 | 75.25 | 3400 | 47.01 | 11.90 | 260 |
| Comparative Example 1 | P-3 | Q-1 | 60:40 | 10000 | 66.33 | 14.55 | 231 |
| Comparative Example 2 | P-3 | Q-1 | 70:30 | 6200 | 49.78 | 11.38 | 231 |
| Comparative Example 3 | P-3 | Q-1 | 80:20 | 4200 | 49.78 | 8.760 | 230 |
| Comparative Example 4 | P-3 | Q-2 | 60:40 | 7000 | 58.51 | 13.36 | 237 |
| Comparative Example 5 | P-3 | Q-2 | 70:30 | 5000 | 44.57 | 10.53 | 238 |
| Comparative Example 6 | P-3 | Q-2 | 80:20 | 3600 | 33.87 | 8.234 | 232 |

P-1: A component represented by general formula (I) in which $R^1$ and $R^2$ each represent $CH_3$ and A represents $C_3H_6$ (the kinematic viscosity at 40° C.: 5.617 $mm^2/s$; the kinematic viscosity at 100° C.: 1.936 $mm^2/s$; the viscosity index: 141).

P-2: A component represented by general formula (I) in which $R^1$ and $R^2$ each represent $CH_3$ and A represents $C_2H_4$ and $C_3H_6$ present in relative amounts of 1:1 (the kinematic viscosity at 40° C.: 7.041 $mm^2/s$; the kinematic viscosity at 100° C.: 2.387 $mm^2/s$; the viscosity index: 185).

P-3: A component represented by general formula (I) in which $R^1$ and $R^2$ each represent $CH_3$ and A represents $C_3H_6$ (the kinematic viscosity at 40° C.: 18.71 $mm^2/s$; the kinematic viscosity at 100° C.: 4.825 $mm^2/s$; the viscosity index: 197).

Q-1: A component represented by general formula (II) in which $R^3$ and $R^4$ each represent $CH_3$ and A' represents $C_3H_6$ (the kinematic viscosity at 40° C.: 302.4 $mm^2/s$; the kinematic viscosity at 100° C.: 52.12 $mm^2/s$; the viscosity index: 238).

Q-2: A component represented by general formula (II) in which $R^3$ and $R^4$ each represent $CH_3$ and A' represents $C_2H_4$ and $C_3H_6$ present in relative amounts of 1:1 (the kinematic viscosity at 40° C.: 247.3 $mm^2/s$; the kinematic viscosity at 100° C.: 47.14 $mm^2/s$; the viscosity index: 249).

Q-3: A component represented by general formula (II) in which $R^3$ and $R^4$ each represent $CH_3$ and A' represents $C_2H_4$ and $C_3H_6$ present in relative amounts of 1:1 (the kinematic viscosity at 40° C.: 171.0 $mm^2/s$; the kinematic viscosity at 100° C.: 33.96 $mm^2/s$; the viscosity index: 245).

Q-4: A component represented by general formula (III) in which $R^5$, $R^6$, $R^7$, $R^8$ and $R^9$ each represent H and $R^{10}$ represents $C_2H_5$ (the kinematic viscosity at 40° C.: 65000 $mm^2/s$; the kinematic viscosity at 100°C.: 500 $mm^2/s$; the viscosity index: 90).

INDUSTRIAL APPLICABILITY

The lubricating oil composition for refrigerators of the present invention can be advantageously used in combination with hydrofluorocarbon-based refrigerants having the ozonosphere destruction potential of zero or so-called natural substance-based refrigerants such as carbon dioxide, ammonia and hydrocarbons having small global warming potential. When the composition is used as the lubricating oil for refrigerators of automobile air conditioners such as automobile air conditioners of the clutchless type, the lubricating oil composition can contribute to the decrease in the energy since the loss in torque at low temperatures can be decreased.

What is claimed is:

1. A lubricating oil composition for refrigerators having a viscosity index of 250 or greater, which comprises a base oil component 1 having a kinematic viscosity of 3 $mm^2/s$ or smaller at 100° C. and a viscosity index smaller than 250 and a base oil component 2 having a kinematic viscosity of 25 $mm^2/s$ or greater at 100° C. and a viscosity index smaller than 250.

2. The lubricating oil composition according to claim 1, wherein a difference between kinematic viscosities of base oil component 1 and base oil component 2 is 25 $mm^2/s$ or greater at 100° C.

3. The lubricating oil composition according to claim 1, wherein base oil component 1 is a component represented by general formula (I):

$$R^1—O—(-A-O—)m-R^2 \quad (I)$$

wherein $R^1$ and $R^2$ each represent hydrogen atom or a hydrocarbon group having 1 to 8 carbon atoms, A represents an alkylene group having 2 to 8 carbon atoms, m represents an integer of 1 or greater and, when m represents an integer of 2 or greater, a plurality of groups represented by A may be a same with or different from each other.

4. The lubricating oil composition according to claim 1, wherein base oil component 1 is a polyalkylene glycol.

5. The lubricating oil composition according to claim 1, wherein base oil component 2 is at least one component selected from a component represented by general formula (II):

$$R^3—O—(-A'-O—)n-R^4 \quad (II)$$

wherein $R^3$ and $R^4$ each represent hydrogen atom or a hydrocarbon group having 1 to 8 carbon atoms, A' represents an alkylene group having 2 to 8 carbon atoms, n represents an integer of 1 or greater and, when n represents an integer of 2 or greater, a plurality of groups represented by A' may be a same with or different from each other; and a component represented by general formula (III):

(III)

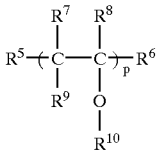

wherein $R^5$ to $R^9$ each represent hydrogen atom or a hydrocarbon group having 1 to 8 carbon atoms, $R^{10}$ represents a hydrocarbon group having 1 to 8 carbon atoms, p represents an integer of 1 or greater and, when p represents an integer of 2 or greater, a plurality of groups represented by each of $R^5$ to $R^{10}$ may be a same with or different from each other.

6. The lubricating oil composition according to claim 1, wherein base oil component 2 is a polyalkylene glycol.

7. The lubricating oil composition according to claim 1, wherein a ratio of an amount by weight of base oil component 1 to an amount by weight of base oil component 2 is in a range of 10:90 to 90:10.

8. The lubricating oil composition according to claim 1, which is used in combination with a hydrofluorocarbon-based refrigerant or a natural substance-based refrigerant.

9. The lubricating oil composition for automobile air conditioners which is described in claim 1.

10. The lubricating oil composition for automobile air conditioners which is described in claim 2.

11. The lubricating oil composition for automobile air conditioners which is described in claim 3.

12. The lubricating oil composition for automobile air conditioners which is described in claim 4.

13. The lubricating oil composition for automobile air conditioners which is described in claim 5.

14. The lubricating oil composition for automobile air conditioners which is described in claim 6.

15. The lubricating oil composition for automobile air conditioners which is described in claim 7.

16. The lubricating oil composition for automobile air conditioners which is described in claim 8.

* * * * *